United States Patent [19]

Handschuh

[11] Patent Number: 4,728,257

[45] Date of Patent: Mar. 1, 1988

[54] THERMAL STRESS MINIMIZED, TWO COMPONENT, TURBINE SHROUD SEAL

[75] Inventor: Robert F. Handschuh, North Olmsted, Ohio

[73] Assignee: The United States of America as represented by the Administrator of the National Aeronautics and Space Administration, Washington, D.C.

[21] Appl. No.: 875,798

[22] Filed: Jun. 18, 1986

[51] Int. Cl.[4] ..... F01D 11/08

[52] U.S. Cl. ..... 415/136; 415/170 R

[58] Field of Search ..... 415/134–136, 415/139, 116, 170 R, 171, 115, 174, 175, 126–128

[56] References Cited

U.S. PATENT DOCUMENTS

| | | | |
|---|---|---|---|
| 2,488,875 | 11/1949 | Morley | 415/136 X |
| 3,690,785 | 9/1972 | Lind | 415/108 |
| 3,860,358 | 1/1975 | Cavicchi et al. | 415/174 |
| 3,892,497 | 7/1975 | Gunderlock et al. | 415/134 |
| 3,986,720 | 10/1976 | Knudson et al. | 277/26 |
| 4,307,993 | 12/1981 | Hartel | 415/174 X |
| 4,527,385 | 7/1985 | Jumelle et al. | 415/170 R X |

FOREIGN PATENT DOCUMENTS

| | | | |
|---|---|---|---|
| 2540938 | 8/1984 | France | 415/170 R |
| 2115487 | 9/1983 | United Kingdom | 415/134 |

*Primary Examiner*—Robert E. Garrett
*Assistant Examiner*—Joseph M. Pitko
*Attorney, Agent, or Firm*—Gene E. Shook; John R. Manning

[57] ABSTRACT

In a turbine machine, a two component shroud seal which maximizes insulation and sealing around the rotating turbine blades and made by independently fabricating each of the two components then joining them together is disclosed. The two components may be joined together at room temperature. The resulting shroud seal provides greater engine efficiency and thrust.

10 Claims, 10 Drawing Figures

THERMAL STRESS MINIMIZED, TWO COMPONENT, TURBINE SHROUD SEAL

ORIGIN OF THE INVENTION

The invention described herein was made by an employee of the U.S. Government and may be manufactured and used by or for the Government for governmental purposes without the payment of any royalties thereon or therefor.

TECHNICAL FIELD

This invention relates generally to turbomachines. The invention is particularly directed to an improved shroud seal for increasing engine thrust and efficiency.

The turbine shroud seal, as used in jet engines, provides an annular seal around the rotating turbine blades. An increase in insulating and sealing qualities provide more engine thrust while increasing engine efficiency. Both gains can be realized in lowering the operational cost of a typical gas turbine engine. The turbine shroud seal has evolved from an all metallic high temperature alloyed structure to a combination of the metallic alloy with ceramic materials.

The metallic alloy, when used alone, provided a failure proof design, but required large amounts of cooling air provided by the compressor to keep its temperature limitations from being exceeded. The cooling flow taken from the compressor then penalizes the overall engine performance.

The most recent advance in this type of seal has been to use ceramics and high temperature alloys in combination. Currently these materials are being used by plasma spraying the ceramic material onto the high temperature alloy base (substrate). The ceramic material is used on the combination gas flow side of the seal while the metallic alloy is used as the substrate and provides the attachment to the rest of the engine structure. This arrangement allows turbine gas temperatures to be increased and at the same time decreases the amount of cooling flow needed from the compressor.

The disadvantage of plasma sprayed ceramics on metallic alloy substrates is the resulting differences in the thermal expansion rates of the different materials used. These differences can cause large thermally induced stresses to exist in the plasma-sprayed ceramic layer. The thermal loading can cause the coating to spall or separate from the metallic alloy. Many attempts have been made to reduce the chance of spalling of the ceramic layer. Two of the possible methods of relieving stress is to use a strain isolation pad between the ceramic and the metallic alloy base or blending of metallic material with the ceramic as it is being applied in the plasma spray operation.

The strain isolation concept provides the required mechanical connection between two thermal expansion mis-matched materials. The composition of this pad is typically made from a high temperature alloy that is some percentage (typically 30%) of the totally dense alloy. The disadvantage of this particular method is that the alloy isolation pad is temperature sensitive just as the substrate alloy. The porous material has a substantially larger surface area per unit volume then dense alloy. This means that oxidation can take place at a much quicker pace than the dense alloy which leads to a shortened life of the isolation layer due to a decay in low carrying capacity.

The metallic graded plasma sprayed layer approach is a method whereby the metallic material is used in varying amounts in individually sprayed layers. Near the substrate the metallic weight percent is higher than the ceramic-metallic plasma sprayed material. As the layer is built up on the substrate the amount of metal added to the ceramic is reduced until the plasma-sprayed layer is all ceramic. The differences in thermal expansion are attenuated by this method, but differences in the layers themselves can still lead to a substantial amount of internal strain.

It is therefore the objective of the invention to provide an improved two-component seal that is thermally strained only by its own thermal gradient.

Another object of the invention is to provide a method for making the improved two-component seal.

Still another object of the invention is to provide a seal with a ceramic component and a metallic alloy component.

Yet another object of the invention is to provide a seal wherein the ceramic member is not constrained by rigid attachment to the substrate.

Another object of the invention is to provide a shroud seal that will appreciably increase engine efficiency and thrust.

BACKGROUND ART

U.S. Pat. No. 3,860,358 to Cavicchi et al is directed to a turbine blade tip seal wherein the radius of curvature of the sealing surface changes thereby minimizing blade tip clearance between cold engine conditions and design operating conditions.

In U.S. Pat. No. 3,986,720 to Knudson et al is directed to a turbine shroud structure composed of a material exhibiting a low coefficient of thermal expansion at low temperatures to provide large cold clearances at a high coefficient of thermal expansion at higher temperatures.

U.S. Pat. No. 3,690,785 to Lind is directed to a spring plate sealing system composed of members having different thermal expansion properties so as to provide sealing at high temperatures.

DISCLOSURE OF THE INVENTION

According to the present invention a two-component shroud seal has a ceramic member and a high temperature metallic alloy member. The members are independently fabricated and joined together by sliding the ceramic member onto the metallic alloy substrate. The resulting seal provides an increase in insulating and sealing qualities and correspondingly produces more engine thrust and efficiency.

BEST MODE FOR CARRYING OUT THE INVENTION

Figure 1:
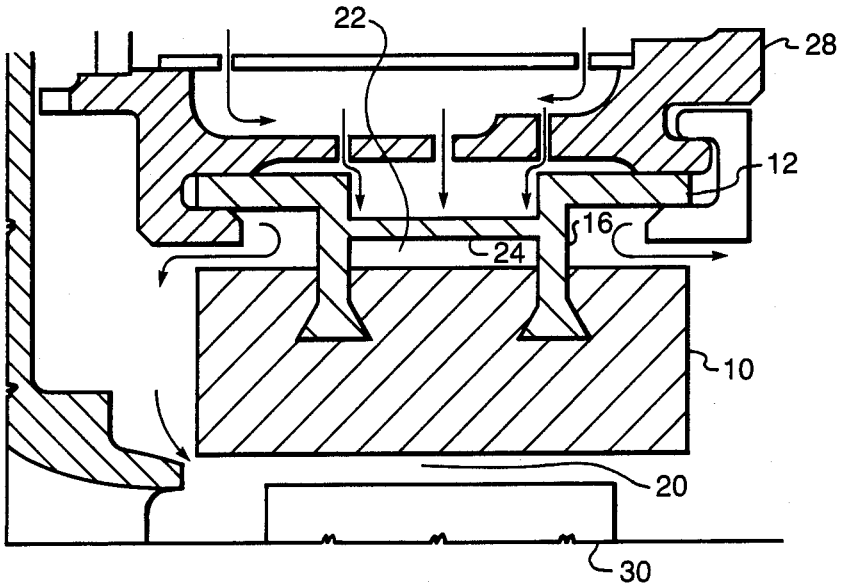
FIG. 1 is a sectional view illustrating a shroud seal in a turbine housing constructed in accordance with the present invention to be used in the annular seal around the turbine blades.

Referring now to the drawings there is shown in FIG. 1 a sectional view of the two component seal having a ceramic member 10, a metallic alloy substrate member 16 with a pair of L-shaped clamping rails 12 for attachment to the turbine housing 28 and a web 24 thereinbetween joining the clamping rails 12. The seal is shown in close proximity to the tips of turbine blades 30. Because there is no rigid attachment of the ceramic member 10 to the substrate member 16 the stress that the seal encounters in its operating environment is minimized.

Figure 2:
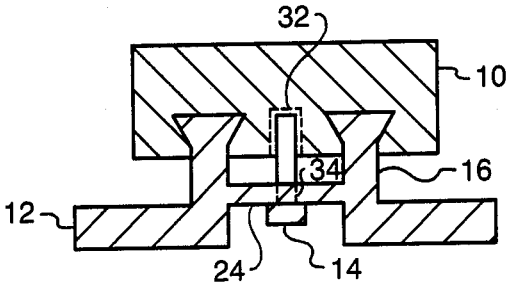
FIG. 2 is a sectional view of the two component shroud seal illustrating the ceramic and substrate components.

Turning now to FIG. 2 there is shown a two component shroud seal having a ceramic component 10 connected to a high temperature alloy substrate component 16. The substrate 16 has a pair of clamping rails 12 for rigid connection to a turbine fan housing 28 as shown in FIG. 1. Further there is a anti-rotational pin 14 which limits the movement of the ceramic component 10 relative to the alloy substrate 16. The anti-rotational pin 14 is inserted substantially perpendicular through corresponding aligned openings 32,34 in the web 24 of the metallic alloy member 16 and the ceramic member 10 respectively. To accomodate the thermal expansion of the two component members, the annular opening 32 in the ceramic member 10 is slightly larger than the opening 34 in the metallic alloy member 16, and its depth is about 25% to 50% the ceramic member 10 thickness which may exceed 0.2 inches. An alternate embodiment could include a pin member 14 permanently attached to the substrate member 16 as by welding.

Figure 3:
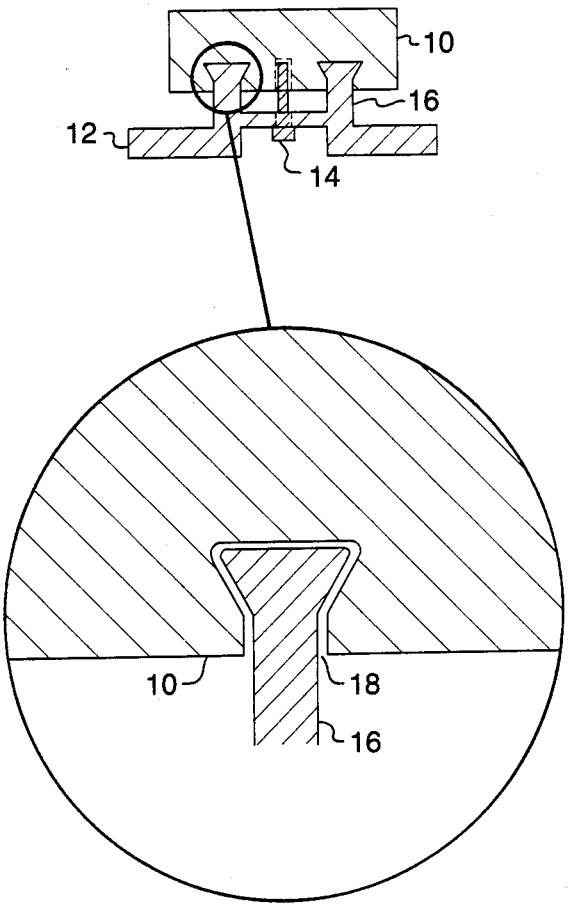
FIG. 3 is an enlarged sectional view illustrating the substrate-ceramic connection location.

An enlarged view of the substrate 16—ceramic 10 connection showing the slot clearance 18 between the two components that exists at ambient conditions is shown in FIG. 3. The slot clearance 18 decreases to impose a clamping load at operating temperatures due to different thermal expansion coefficients of the two components. Accordingly the present invention does not have the constraint conditions that are imposed by rigidly fixing coatings on high temperature metallic substrates. Furthermore, the ceramic shroud segment 10 of this seal system would not be plasma sprayed but would be manufactured by an alternative ceramic forming operation. The segment 10 could be made in a near net shape that would minimize the amount of post-curing machining. Two of the possible methods that could be implemented include injection molding and hot isostatic pressing. These forming techniques and the proper control over ceramic composition facilitates the production of reliable components produced with the desired material properties.

The alloy substrate 16 or the structural component of this seal could be made from a high temperature alloy material such as an alloy known commercially as Hastelloy-X. At room temperature there is clearance 18 to facilitate assembling of the seal. The clearance 18 between the ceramic 10 and the high temperature alloy substrate 16 depends on the clamping load needed as well as the stress that can be tolerated. Until steady state conditions are reached the ceramic component 10 is held by a radial or antirotational pin 14 that prevents circumferential motion of the ceramic member 10. The arrangement for the two-component seal can be further simplified by having only one slot instead of two as in the preferred embodiment of this invention.

Figure 4:
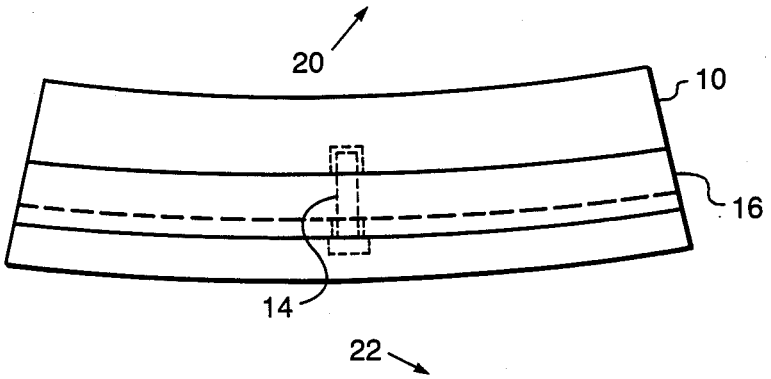
FIG. 4 is a side view illustrating the cooling flow and hot (combustion) gas side of the shroud seal.

In FIG. 4 there is shown a side view of the shroud seal illustrating the hot gas or combustion side 20 and the cool flow side 22. During operation, hot gases flow axially across the seal surface as shown by the arrows. This then causes a thermal gradient to exist from the hot gas side 20 to the cooling flow side 22. The existence of the thermal gradient results in thermal stress in the ceramic component 10 as will be more fully described below.

Figure 5A:
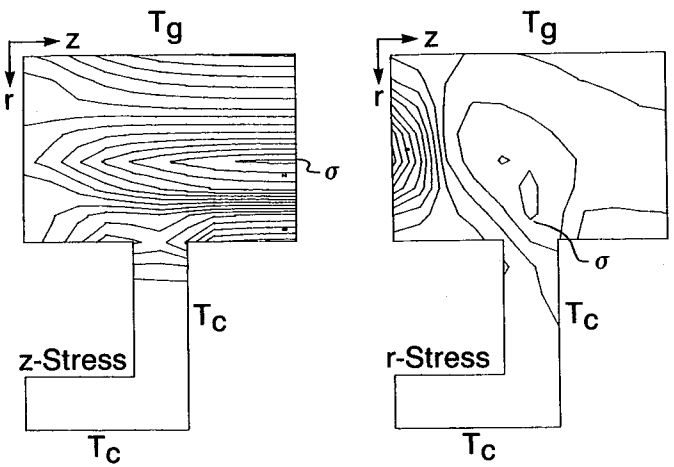
FIGS. 5*a* and 5*b* show a thermal stress contour for conventional graded layer and strain isolation seals at boundary conditions of $T_g=1600°$ C. (3000° F.) and $T_c=700°$ C. (1209° F.)
Figure 5B:
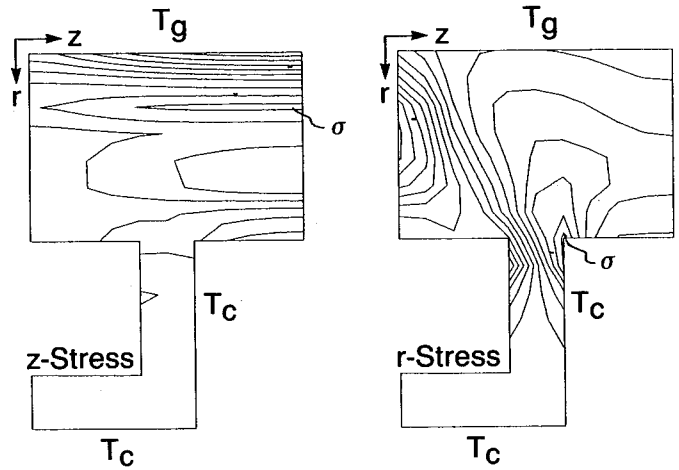
Figure 6A:
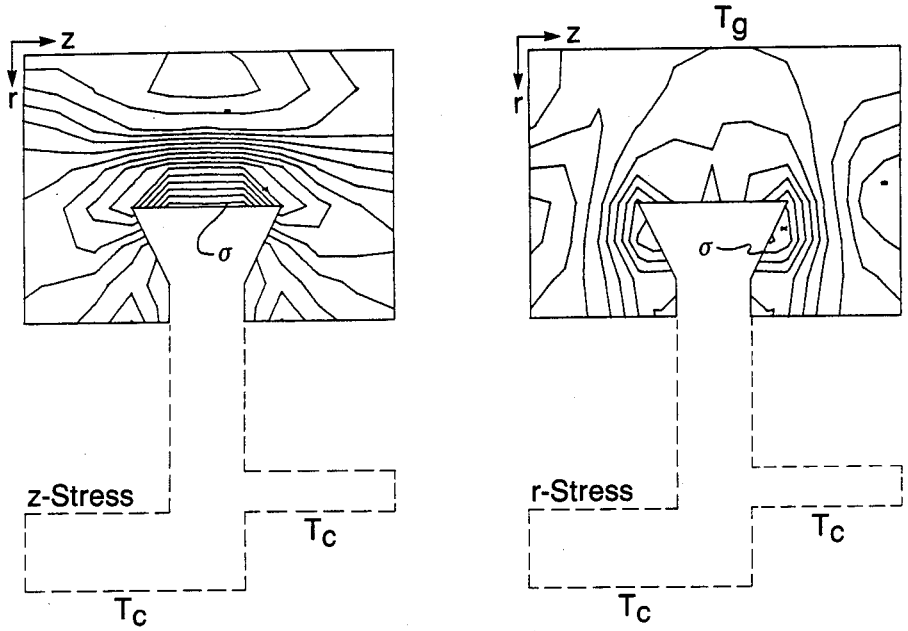
FIGS. 6*a* and 6*b* are a schematic view showing a thermal stress contour of the effect of hot gas boundary condition on the two-component seal of the present invention; and, FIGS. 7*a* and 7*b* are a schematic view showing a thermal stress contour of the effect of pressure loading between the substrate and the ceramic material.
Figure 6B:
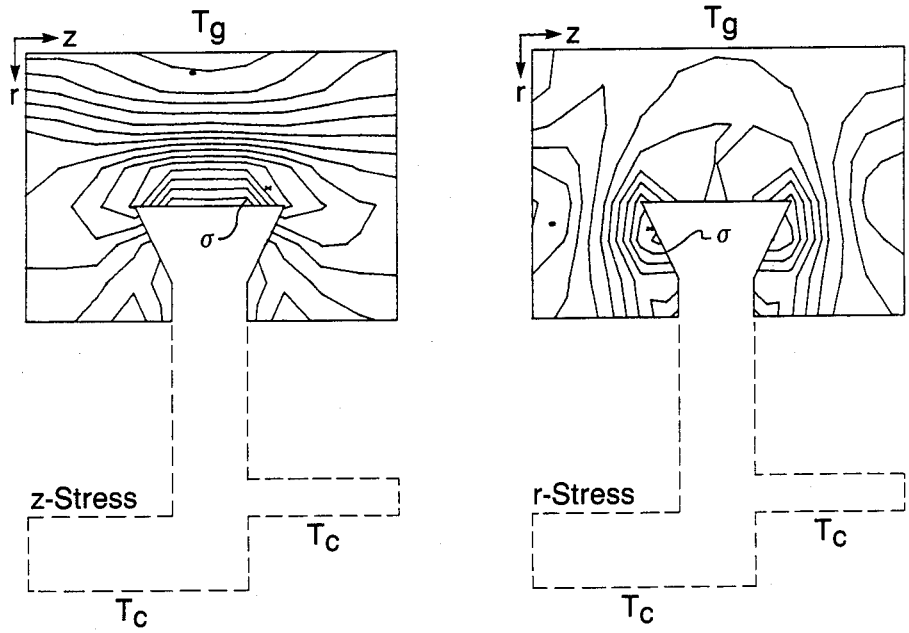
Figure 7A:
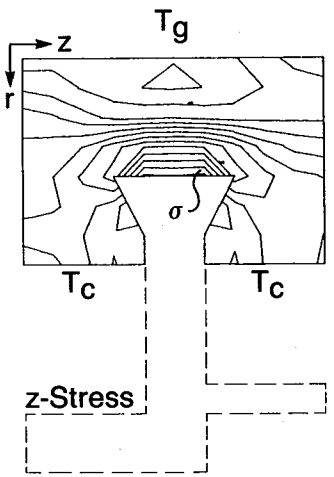
Figure 7A:
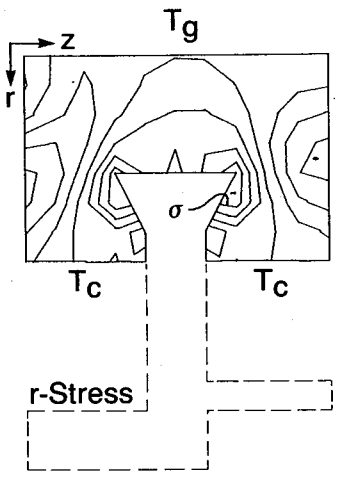
Figure 7B:
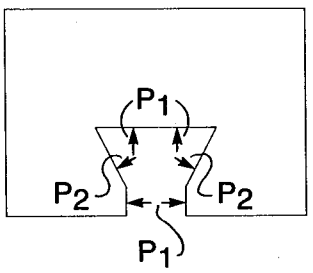
Figure 7B:
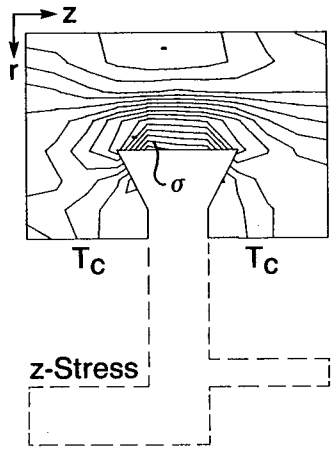
Figure 7B:
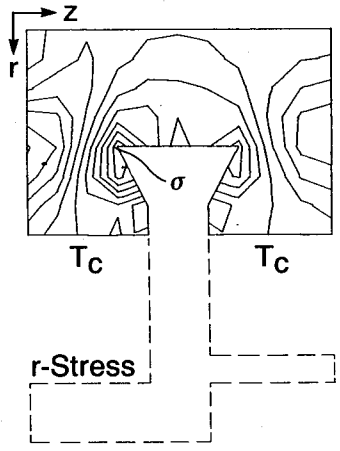

Turning now to the thermal stress characteristics, a comparison between the finite element results of presently existing seal systems and the novel two-component seal of this invention is shown in FIGS. 5–6. In FIG. 5 is shown the thermal stress contour for graded layer and strain isolation seals at boundary conditions of $T_g=1650°$ C. (3000° F.) and $T_c=700°$ C. (1290° F.). Table I provides stress values (MPa) for both types of seal systems.

TABLE I

| | | Element stress values | | Contour values using nodal stress | |
|---|---|---|---|---|---|
| Seal | Direction | "x" Maximum MPa (psi) | "o" Minimun MPa (psi) | Increment between contours MPa (psi) | Maximum tension contour "o" MPa |
| Graded layer seal | z | 64.4 | −57.6 | 7.2 | 52.7 |
| | | (9340) | (−8360) | (1040) | (7640) |
| | r | 8.07 | −27.7 | 2.8 | 6.1 |
| | | (1170) | (−4020) | (405) | (880) |
| Strain isolation seal | z | 27.7 | −37.2 | 5.7 | 12.8 |
| | | (1860) | −(5400) | (825) | (4010) |
| | r | 5.7 | −6.5 | 0.7 | 3.9 |
| | | (825) | (−940) | (105) | (560) |

In FIG. 6 the effect of hot gas boundary condition change is shown. The change in this boundary condition to the high temperature gas side 20 surface temperature causes the magnitude of the stress component to increase. Table II provides stress values MPa for the novel two-component seal of the present invention.

TABLE II

| Condition 2-piece seal | Direction | Element stress values "x" Maximum Mpa (psi) | Element stress values "o" Minimum Mpa (psi) | Contour values using nodal stress: Increment between contours MPa (psi) | Contour values using nodal stress: Maximum tension contour "o" MPa (psi) |
|---|---|---|---|---|---|
| $T_g$ = 1650° C. | z | 7.9 | −3.96 | 0.7 | 7.1 |
| (3000° F.) | | (1140) | (−575) | (102) | (1030) |
| $T_c$ = 700° C. | r | 6.2 | −2.1 | 0.57 | 2.9 |
| (1290° F.) (a) | | (895) | (−300) | (83) | (420) |
| $T_g$ = 1370° C. | z | 5.3 | −3.7 | 0.7 | 4.6 |
| (2500° F.) | | (765) | (−535) | (82) | (670) |
| $T_c$ = 700° C. | r | 3.9 | −1.5 | 0.36 | 2.3 |
| (1290° F.) (b) | | (570) | (−215) | (52) | (330) |

The stress fields of the present invention as shown in FIG. 6*a* can be compared to the stress fields of the other two seal systems. Accordingly, the difference in magnitudes between the conventional seals shown in FIG. 5 and the novel two-component seal of the present invention as shown in FIG. 6 is apparent, with stresses in the two-piece seal being substantially lower than in the other two seal designs.

Furthermore, in FIG. 7, the effect of pressure loading between the substrate 16 and the ceramic 10 of FIG. 3 is shown. The test pressure load was applied such that the sum of the loads would not violate static equilibrium. The analysis shows that the slot's pressure increases the magnitude of the stress in the ceramic 10 of FIG. 3. In Table III, the effect of pressure loading on the two-component seal is shown. The magnitude of the stresses present due to the pressurized slot is still much lower than that from the other two seal concepts in the top ceramic surface near the high temperature side of the seal.

TABLE III

| Condition | Direction | Element stress values "x" Maximum MPa (psi) | Element stress values "o" Minimum MPa (psi) | Contour values using nodal stress: Increment between contours MPa (psi) | Contour values using nodal stress: Maximum tension contour "o" MPa (psi) |
|---|---|---|---|---|---|
| No pressure | z | 9.0 | −4.5 | 1.0 | 8.3 |
| in slot (a) | | (1305) | (−645) | (150) | (1200) |
| | r | 4.7 | −1.9 | 0.58 | 1.9 |
| | | (675) | (−280) | (84) | (270) |
| Pressure | z | 11.8 | −5.1 | 1.05 | 9.5 |
| in slot (b) | | (1715) | (−740) | (152) | (1380) |
| $P_1$ = 0.69 MPA | r | 6.4 | −2.9 | 0.58 | 3.1 |
| $P_2$ = 0.31 MPA | | (930) | (−420) | (84) | (950) |

Accordingly, the two-component seal has lower total stress due to thermal loading than the other two seal designs. This is due to the absence of rigid constraint put on the ceramic layer 10 of FIG. 3.

While the invention has been described with reference to certain preferred embodiments thereof, those skilled in the art will appreciate that various modifications, changes, omissions and substitutions may be made without departing from the spirit of the invention. It is intended, therefore, that the invention be limited only by the scope of the following.

What is claimed is:

1. In a turbomachine of the type having rotating blades within a housing adapted to expose to variable speeds and very high temperature operating conditions, the improvement comprising a shroud consisting of:

a ceramic member having a hot gas face and a cooling flow face, said cooling flow face having an annular opening therein;

a metallic alloy member contiguous to said ceramic member and moveable relative thereto, and having an aperture therethrough correspondingly aligned with said annular opening in said ceramic member;

an antirotational pin member having a diameter smaller in size than said ceramic member annular opening, inserted substantially perpendicularly through said metallic alloy member aperture and through said ceramic member annular opening, thereby restraining circumferential motion of said ceramic member at ambient temperature; and means for slideably mounting said metallic alloy member onto said ceramic member.

2. An improved seal in a turbomachine as set forth in claim 1 wherein said ceramic member thickness is greater than 2 inches.

3. An improved turbomachine as set forth in claim 1 wherein said metallic alloy member comprises two substantially L-shaped clamping rails rigidly joined therebetween by a web.

4. An improved turbomachine as set forth in claim 1 wherein said ceramic member and said metallic alloy member are independently formed and fabricated.

5. An improved turbomachine as set forth in claim 1 wherein said antirotational pin is rigidly attached to said metallic alloy member.

6. An improved turbomachine as set forth in claim 5 wherein said antirotational pin further extends substantially perpendicularly through from about 25% to about 50% of said ceramic member thickness.

7. An improved turbomachine as set forth in claim 1 wherein said antirotational pin is positioned in said web of said metallic alloy member equidistantly between said alloy clamping rails.

8. An improved turbomachine as set forth in claim 1 wherein said antirotational pin is independently fabricated of a high temperature alloy.

9. A method of manufacturing an article having two components with widely varying coefficients of thermal expansion for use in a high temperature environment comprising the steps of:

forming one said component having at least one slot therein and at least one annular opening therein adjacent thereto;

forming another of said components comprising a pair of spaced clamping rails joined therebetween by a web and at least one annular opening in said web;

forming an anti-rotational pin member;

slideably inserting a portion of said rails into said slot with said annular openings in said two components in substantial alignment for insertion of said pin thereby limiting relative movement between said components; and inserting said anti-rotational pin through one of said components and through less than about 50% of the thickness of the other of said components.

10. The method of making an article as recited in claim 9 which further includes the step of attaching said article to a housing.

* * * * *